US006467940B2

(12) United States Patent
Eschler et al.

(10) Patent No.: US 6,467,940 B2
(45) Date of Patent: Oct. 22, 2002

(54) HEADLIGHT FOR VEHICLE OPERATING IN ACCORDANCE WITH PROJECTION PRINCIPLE AND ILLUMINATION DEVICE WITH AT LEAST ONE SUCH HEADLIGHT

(75) Inventors: Johannes Eschler, Ditzingen (DE); Reinhold Fiess, Durbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/866,409

(22) Filed: May 25, 2001

(65) Prior Publication Data

US 2002/0001198 A1 Jan. 3, 2002

(30) Foreign Application Priority Data

May 31, 2000 (DE) ..... 100 27 018

(51) Int. Cl.[7] ..... F21V 11/00; F21V 9/14; F21V 11/18

(52) U.S. Cl. ..... 362/510; 362/19; 362/293; 362/512; 362/284; 362/319; 362/539

(58) Field of Search ..... 362/19, 509, 510, 362/341, 293, 512, 513, 280, 284, 319, 322, 323, 324, 351, 538, 539

(56) References Cited

U.S. PATENT DOCUMENTS 6,015,220 A * 1/2000 Blusseau ..... 362/303
6,193,400 B1 * 2/2001 Schuster et al. ..... 362/538
6,280,067 B1 * 8/2001 Albou ..... 362/459

FOREIGN PATENT DOCUMENTS

DE 196 21 254 A1 11/1997

* cited by examiner

*Primary Examiner*—Alan Cariaso
*Assistant Examiner*—Sharon Payne
(74) *Attorney, Agent, or Firm*—Michael J. Striker

(57) ABSTRACT

A headlight for a vehicle operating in accordance with projection principle has a light source, a reflector which reflects a light emitted by the light source as a light bundle, a screening device arranged in a path of rays of the light bundle reflected by the reflector and producing a bright-dark limit of the light exiting the headlight in visible wavelength region, a lens arranged after the screening direction in a light outlet direction so that the light reflected by the reflector passes through the lens, the screening device at least locally being at least partially permeable for light in infrared wavelength region, and light which passes through the screening device in infrared wavelength region has a greater range than light passing over the screening device in visible wavelength region.

13 Claims, 2 Drawing Sheets

HEADLIGHT FOR VEHICLE OPERATING IN ACCORDANCE WITH PROJECTION PRINCIPLE AND ILLUMINATION DEVICE WITH AT LEAST ONE SUCH HEADLIGHT

BACKGROUND OF THE INVENTION

The present invention relates to headlight for a vehicle, operating in accordance with projection principle and to an illumination device with at least one such headlight.

The German patent document DE 196 21 254 A1 discloses such a headlight. The headlight has a light source and a reflector by which light emitted by the light source is reflected. In a path of rays of a light bundle reflected by the reflector, a screening device is arranged and formed as a screen which screens a part of the light bundle reflected by the reflector and is not permeable for the light in visible wave length region. The screening device produces a bright-dark limit of the visible light exiting the headlight. In the light outlet direction after the screening device, a lens is arranged for passing the light reflected by the reflector and passed over the screening device. The screening device is required for producing the bright-dark limit, to prevent a blinding of the opposite traffic by the visible light. However, it limits a visibility range for the vehicle driver, so that he can not recognize objects located at a great distance since they are not eliminated.

SUMMARY OF THE INVENTION

Accordingly, it is an object of the present invention to provide a headlight for a vehicle operating in accordance with projection principle and an illumination device with at least one such headlight, which eliminate the disadvantages of the prior art.

In keeping with these objects and with others which will become apparent hereinafter, one feature of present invention resides, briefly stated, in a headlight in which the screening device is at least partially permeable at least locally for light in infrared wavelength region and the light passing through the screening device in infrared wavelength region has a greater range than the light passing over the screening light in visible wavelength region.

When the headlight is designed in accordance with the present invention then, additionally to the illumination of the region in front of the vehicle with light in visible wavelength region, the region located at a great distance is illuminated with light in infrared wavelength region. This provides a possibility for an improvement in conditions of visibility for the vehicle driver, without blinding the opposite traffic. No additional components must be provided in the headlight when compared with the known solutions.

The illumination device designed in accordance with the present invention has a sensor device and an indicating device. It has the advantage that, due to the sensor device which detects the region illuminated in the infrared wavelength region, and the indicating device for the vehicle driver, the vehicle driver can also recognize objects located at a great distance.

In accordance with another embodiment of the present invention, the screening device is movable between a position in which it extends in the path of rays of the light bundle reflected by the reflector and another position in which it is located further in the path of rays. In this construction an additional high beam function with the light in visible wave length region is provided.

In accordance with another feature of present invention, the screening device at its side facing the reflector is at least partially reflective for light in visible wavelength region. In this construction the use of the light screened by the screening device is possible in the visible wavelength region.

In accordance with still another feature of the present invention the screening device is at least partially permeable locally for the light in infrared wavelength region and at least locally impermeable for the light in infrared wavelength region. In such a construction a desired determination of the region or regions which is/are illuminated with the light in infrared wavelengths regions is provided.

In still a further embodiment of the present invention, the light source operates with modulation, and the modulation frequency is preferably at least substantially 100 Hz. This eliminates an influence of light caused by the other light sources in the infrared wavelength region.

Finally, in the path of rays of the light passing over the screening device and in infrared wavelength region, a polarization device can be arranged with which the passing light is linearly polarized. This eliminates an influence of light caused by other light sources in infrared wavelength region as well.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
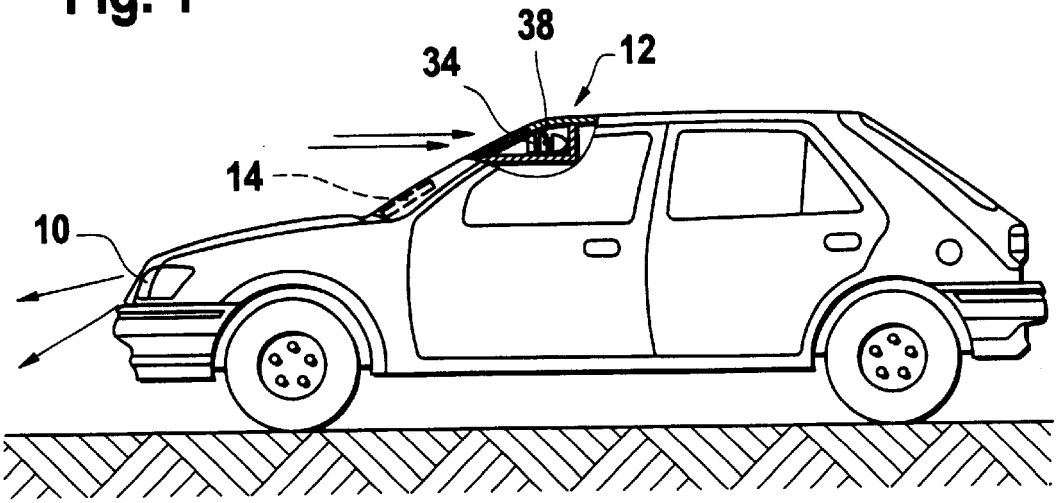
FIG. 1 is a view showing a vehicle with an illumination device in a schematic representation with a headlight in accordance with the present invention.

FIG. 1 shows a vehicle, in particular a motor vehicle, provided with an illumination device. The illumination device has at least one headlight 10 which is arranged on a front end of the body of the motor vehicle and will be described herein below.

Conventionally, two headlights 10 are provided, which are arranged near the lateral edges of the body of the vehicle. The headlight emits both light in visible wavelength region and also light in visible infrared wavelength region. The visible light provides illumination which is directly observable in front of the vehicle, while the infrared light provides illumination which is not directly observable by the vehicle driver. For this purpose the illumination device has a sensor device 12, with which the region in front of the vehicle illuminated by the infrared light is detected.

The sensor device 12 can be for example a video camera, a CCD sensor or a CMOS sensor. The sensing device 12 is connected with an indicating device 14 which is arranged in a visual field of the vehicle driver. It can indicate for the vehicle driver the region which is illuminated by the infrared light and detected by the sensor device 12. The indicating device 14 can be for example an image screen or a projection device, with which an image of the region sensed by the sensor device 12 can be produced on the windshield of the vehicle.

The construction of the headlight 10 is as follows. The headlight 10 is formed in accordance with the projection principle and has a light source 20 which emits both light in visible wavelength region and also in invisible wavelength region, at least in infrared wavelength region. The light source 20 can be an incandescent lamp or preferably a gas discharge lamp. The light source 20 is inserted in a concavely curved reflector 22 which reflects the light emitted by the light source 20 as a light bundle. The reflector 22 can have a shape of an ellipsoid or similar to an ellipsoid, so that it reflects a converging light bundle. The light body of the light source 20, or in other words its incandescent coil or its light arc, is arranged substantially in the region of the inner focal point of the reflector 22.

A screening device 24 which is formed as a screen is arranged in the path of rays of the light bundle reflected by the reflector 22. It is impermeable for light in visible wavelength region. The screening device 24 is arranged substantially under the optical axis 23 of the reflector 22 and has an upper edge 26. The screening device 24 screens a part of the visible light bundle reflected by the reflector so that it does not come out from the headlight. The light which passes over the screening device 24 in visible wavelength region provides a bright-dark limit in correspondence with the position and the shape of the upper edge 26 of the screening device 24. The screening device 24 can be arranged substantially in the plane of the front edge of the reflector 22 as seen in the light outlet direction 28 or offset relative to it in the light outlet direction 28.

A lens 30 is arranged in the light outlet direction 28 after the screening device 24 for passing the light bundle which is reflected by the reflector 22 and passes over the screening device 24. The light bundle is deviated during passage through the lens 30, so that it produces a predetermined illumination intensity distribution required for illumination of the region in front of the vehicle. The lens 30 has a substantially flat side facing toward the reflector 22 and a substantially convexly curved side which faces away from the reflector and preferably has an a spherical curvature. The upper edge 26 of the screening device 24 is formed as an upper bright-dark limit, which limits the region illuminated by the light bundle exiting the headlight. With the bright-dark limit, a blinding of the counter traffic is avoided. The light bundle in the visible wave length region which exits the headlight is a low beam light, preferably a low beam bundle. The light outlet opening of the headlight 30 can be covered with a light permeable member formed as a disk 32. It can be smooth, so that the light passing through it is substantially unaffected. On the other hand, it can be provided at least locally with optical profiles for deviating and/or dispersing the light passing through it.

Figure 3:
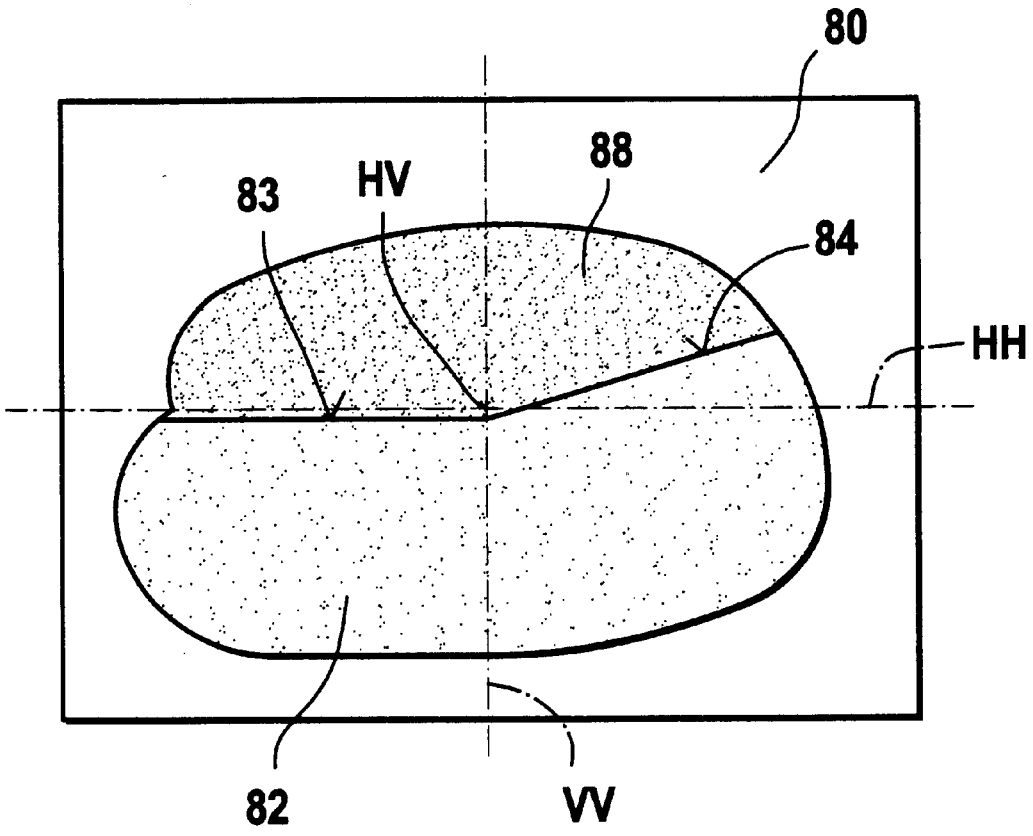
FIG. 3 is a view showing a measuring screen arranged in front of the headlight.

FIG. 3 shows a measuring screen 80 which is arranged at a distance from the headlight and illuminated by the light emitted by the headlight. The measuring screen 80 has a horizontal central plane HH and a vertical central plane VV which intersects in a point HV. The measuring screen 80 represents the projection of a roadway located in front of the reflector, which is correspondingly illuminated. The measuring screen 80 is illuminated by the light emitted by the headlight in visible wavelength region in a region 82. The region 82 is limited from above by the bright-dark limit which is determined by the upper edge 26 of the screening device 24. The bright-dark limit at the counter traffic side, which in the shown embodiment is the left side of the measuring screen 80 for the right traffic, has a horizontal portion 83. It extends substantially under the horizontal central plane HH of the measuring screen 80. At the traffic side which with the right traffic is the right side of the measuring screen 80, the bright-dark limit has a portion 84 extending from the horizontal portion 83 and raising to the right. The light bundle which is emitted from the headlight in visible wave length region thereby has at the traffic side a greater range than at the counter traffic side.

In accordance with the present invention the screening device 24 at least locally is at least partially permeable for light in infrared wavelength region. Preferably, the screening device 24 is at least partially permeable for light in near infrared wavelength region between substantially 780 nm and substantially 7 $\mu$m. The reflector 22 in a region by which the light emitted from the light source 20 is reflected and extends toward the screening device 24, is formed so that it reflects the light whose portion in infrared wavelength region after passage through the screening device 24 and the lens 30 has a greater range than the light passing over the screening device 24 in visible wavelength region. The light passing through the screening device 24 in infrared wavelength region illuminates a region 88 of the measuring screen 80 which is arranged higher than the region 82 illuminated by the visible light, and on the roadway is arranged correspondingly farther than the region 82. Preferably, the remote region 88 is connected directly above the bright-dark limit 83, 84 at the region 82. With the sensing device 12, the far region 88 is sensed and indicated on the indicating device 14 for the vehicle driver. Therefore the vehicle driver can recognize the objects located in the far region 88. The far region 88 substantially corresponds to a high beam region which is illuminated by the turned-on high beam with visible light.

The screening device 24 can be formed at least partially reflective for light in visible wavelength region at its side which faces the reflector 22 at least in the region in which it is permeable for the light in infrared wavelength region. Thereby visible light is reflected by the screening device 24 back to the reflector 22, and the reflector can reflect this light at least partially so that it passes over the screening device 24 and exits the headlight. The screening device 24 can be formed at least partially as reflective interference filter. The screening device 24 can be permeable over its entire surface for light in infrared wavelength region, or only in one or several partial regions, while the screening device 24 in the remaining partial regions is adsorbing or reflecting for the light in infrared wavelength region. Thereby the position and the size of the far region 88 which is illuminated on the measuring screen 80 by the light in infrared wavelengths region can be provided selectively, and the illumination intensity of the far region 88 can be determined.

The light source 20 can operate constantly or in a pulsed fashion or modulated fashion. The modulation frequency amounts preferably to at least approximately 100 Hz so that for the human eye the modulation is not observed in a disturbing way. The sensor device 12 operates synchronously with the light source 20, or in other words with the same modulation frequency, so that the illumination of the far region 88 by it can be sensed only when it is illuminated by the light source 20. The sensor device 12 can be provided with a screen 24, with which the light impingement in the sensor device 12 is controlled. By a modulated operation of the light source 20 and the sensor device 12, a blinding of the sensor device 12 it is possible to avoid or at least reduce the light which causes blinding of the sensor device 12 by other light sources, for example light sources of the headlights of oppositely coming vehicles and the light directly impinging on the sensor device 12.

Alternatively or additionally to the above illustrated modulation of the light source 20, it can be also provided that a polarization device 36 is arranged in the path of rays of light which passes through the screening device 24. The polarization device linearly polarizes the infrared light exiting the headlight. The polarization device 36 can be for example mounted on the screening device 24 or on the cover disk 32, or can be formed as a separate component in the path of rays of light passing through the screening device 24. A second polarization device 38 can be arranged in the path of rays of the light impinging on the sensor device 12 and is identified as an analyzer. Its polarization direction can be turned relative to the polarization direction of the polarization device 36 by 90°. With the polarization devices 36, 38 a blinding of the sensor device 12 by other light sources, for example light sources of headlights of oppositely coming vehicles and also by light directly falling on the sensor device 12 can be avoided. The reason is that due to the different polarization devices, this light can not enter the sensor device 12 or can enter in a weak end way.

Figure 2:
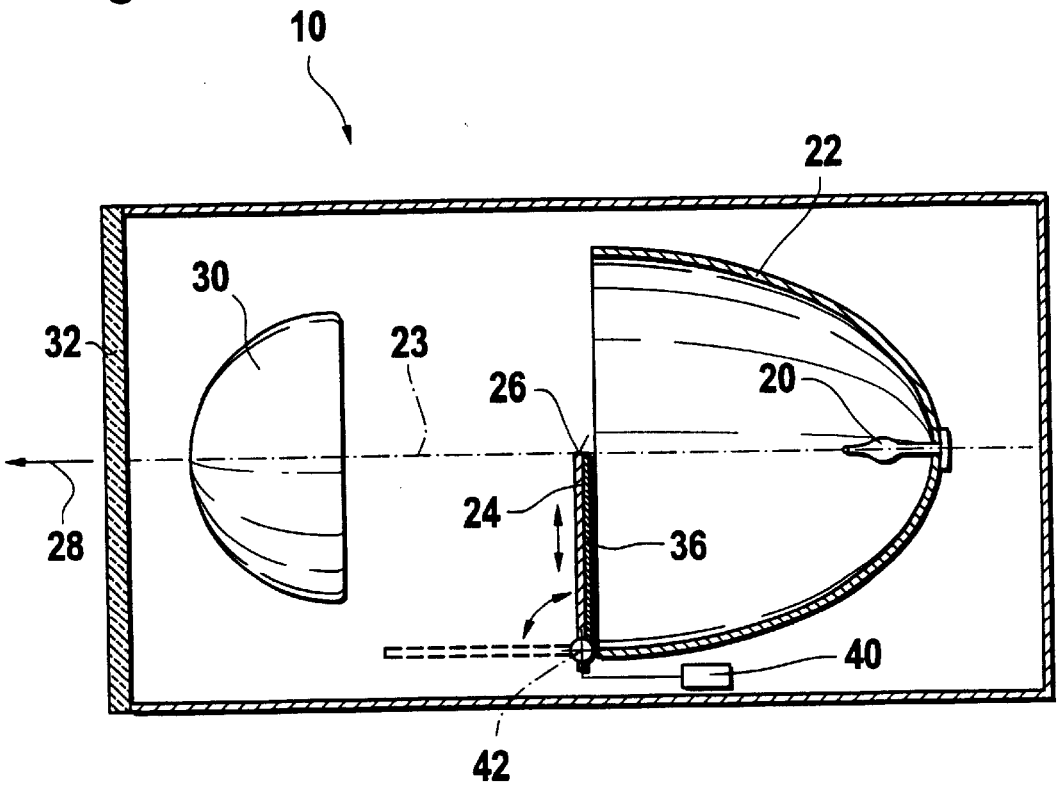
FIG. 2 is a view showing a headlight on an enlarged scale in accordance with the present invention.

The screening device 24 can be arranged stationarily in the headlight 10 or can be movable between a position in which it is arranged in the path of rays of the light beam reflected by the reflector 22 and with its upper edge 26 produces the bright-dark limit 83, 84 of the visible light beam, and at least a further position in which the screening device 24 extends at least farther in the path of rays of the light bundle reflected by the reflector 22 or outside the path of rays. An adjusting element 40 engages the screening device 24 in order to move the latter. The screening device can be displaceable for example in a vertical direction or can be turnable about an axis 42 which extends for example horizontally. The screening device 24 is shown in FIG. 2 in solid lines in its position in which it extends in the path of rays, and it is shown in broken lines in its position in which it is removed from the path of rays. When the screening device 24 is located in its position extending in the path of rays, it produces the bright-dark limit 83, 84 of the visible light bundle. The headlight 10 emits a low beam bundle with visible light which illuminates the region 82 and a high beam bundle with infrared light which illuminates the far region 88, with which no blinding of the opposite traffic is caused. In this position, the screening device is located when the low beam light of the vehicle is turned on. When the screening device 24 is moved from the path of rays of the light bundle reflected by the reflector 22, the visible light bundle exits the headlight 10 and illuminates the region 82. In this position the screening device 24 is located when the high beam of the vehicle is turned on and no counter traffic is available. In addition visible light exits also which otherwise is screened by the screening device 24, so that also the far region 88 is illuminated with visible light and thereby a conventional high beam in visible wavelength region is materialized.

For the illumination of the far region 88, no additional headlight and no additional light source is needed, and the headlight 10 needs no additional components. However, the screening device 24 is modified when compared with the completely light-impermeable existing device, so that it is at least partially permeable for the light in infrared wavelength region.

It will be understood that each of the elements described above, or two or more together, may also find a useful application in other types of constructions differing from the types described above.

While the invention has been illustrated and described as embodied in headlight for vehicle operating in accordance with projection principle and illumination device with at least one such headlight, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A headlight for a vehicle operating in accordance with projection principle, comprising a light source; a reflector which reflects a light emitted by said light source as a light bundle; a screening device arranged in a path of rays of the light bundle reflected by said reflector and producing a bright-dark limit of the light exiting the headlight in visible wavelength region; a lens arranged after said screening direction in a light outlet direction so that the light reflected by the reflector passes through said lens, said screening device being at least partially permeable for light in infrared wavelength region, and light which passes through the screening device in infrared wavelength region has a greater range than light passing over said screening device in visible wavelength region.

2. A headlight as defined in claim 1, wherein said screening device is at least partially permeable for light near infrared wavelength region.

3. A headlight as defined in claim 1, wherein said screening device is movable between a position in which it extends in the path of rays of the light bundle reflected by said reflector and at least one further position in which it extends at least farther in the path of rays.

4. A headlight as defined in claim 1, wherein said screening device has a side which faces said reflector and at said side is at least partially reflected locally for light in visible wavelength region.

5. A headlight as defined in claim 1, wherein said screening device is formed at least locally as a reflecting interference filter.

6. A headlight as defined in claim 1, wherein said screening device locally is at least partially permeable for light in infrared wavelength region and locally is impermeable for light in infrared wavelength region.

7. A headlight as defined in claim 1, wherein said light source is a gas discharge lamp.

8. A headlight as defined in claim 1, wherein said light source is formed as a light source which operates with modulation.

9. A headlight as defined in claim 8, wherein said light source is formed as a light source which operates with a modulation frequency at least approximately 100 Hz.

10. A headlight as defined in claim 1; and further comprising a polarization device arranged in a path of rays of light which passes through said screening device in infrared wavelength region, for linearly polarizing the passing light.

11. An illumination device, comprising at least one headlight which includes a light source, a reflector which reflects a light emitted by said light source as a light bundle, a screening device arranged in a path of rays of the light bundle reflected by said reflector and producing a bright-dark limit of the light exiting the headlight in visible wavelength region, a lens arranged after said screening direction in a light outlet direction so that the light reflected by the reflector passes through said lens, said screening device being at least partially permeable for light in infrared wavelength region, and light which passes through the screening device in infrared wavelength region has a greater range than the light passing over said screening device in visible wavelength region; a sensor device which is operative for sensing the light in infrared wavelength region which passes through said screening device and which senses a region illuminated by said light in infrared wavelength region; and an indicating device arranged in a visible area for a vehicle driver and indicating the region sensed by said sensing device.

12. An illumination device as defined in claim 11, wherein said sensing device has a screen for controlling a light impingement on said sensing device, said screen being open and closed synchronously to a modulation frequency of said light source.

13. An illumination device as defined in claim 11, wherein said headlight has a polarization device arranged in a path of rays of the light in infrared wavelength region which passes through said screening device, for linearly polarizing said light in infrared region; and further comprising a further polarization device which is arranged in a path of rays of the light impinging on the sensor device and linearly polarizing the passing light, said polarization devices being formed so that a polarization direction of said polarization device of said headlight is at least approximately perpendicular to a polarization direction of said further polarization device.

* * * * *